US007021927B1

(12) United States Patent
Gryzlak

(10) Patent No.: US 7,021,927 B1
(45) Date of Patent: Apr. 4, 2006

(54) COLLAPSIBLE CANDLE STAND

(75) Inventor: Joseph Gryzlak, Carpentersville, IL (US)

(73) Assignee: Design Ideas, Ltd., Springfield, IL (US)

( * ) Notice: Subject to any disclaimer, the term of this patent is extended or adjusted under 35 U.S.C. 154(b) by 166 days.

(21) Appl. No.: 10/662,589

(22) Filed: Sep. 15, 2003

(51) Int. Cl.
*F23D 3/16* (2006.01)

(52) U.S. Cl. ..... 431/295; 431/296; 248/166; 248/177.1

(58) Field of Classification Search ..... 431/288–297, 431/253, 343; 362/159, 161, 162; 248/163.2, 248/164–168, 177.1, 176.1
See application file for complete search history.

(56) References Cited

U.S. PATENT DOCUMENTS

| | | | | | |
|---|---|---|---|---|---|
| 227,693 | A | * | 5/1880 | Kiesele | 431/295 |
| 269,283 | A | | 12/1882 | Hall | |
| 1,602,296 | A | | 10/1926 | Zimmerman | |
| 1,778,597 | A | * | 10/1930 | Herzog | 248/158 |
| 2,219,112 | A | | 10/1940 | O'Day | |
| 2,527,706 | A | | 10/1950 | Curtis | |
| 2,734,709 | A | * | 2/1956 | Harrison | 248/168 |
| 3,091,106 | A | * | 5/1963 | Crouch | 431/290 |
| 3,475,109 | A | | 10/1969 | Sayles et al. | |
| 3,708,144 | A | * | 1/1973 | Nasmith | 248/167 |
| 3,929,230 | A | | 12/1975 | Luthi | |
| 4,404,621 | A | | 9/1983 | Mauro | |
| 4,721,455 | A | * | 1/1988 | Barfus | 431/295 |
| 5,568,966 | A | | 10/1996 | Miller et al. | |
| 5,827,483 | A | * | 10/1998 | Fullam | 422/122 |
| 6,062,701 | A | | 5/2000 | Hines | |
| 6,254,250 | B1 | | 7/2001 | Shieh | |
| 6,334,694 | B1 | | 1/2002 | Huang | |

FOREIGN PATENT DOCUMENTS

| | | |
|---|---|---|
| DE | 429451 | 5/1926 |
| JP | 8189597 | 7/1996 |

* cited by examiner

*Primary Examiner*—James C. Yeung
(74) *Attorney, Agent, or Firm*—Saidman DesignLaw Group

(57) ABSTRACT

A candle stand for holding and displaying a plurality of candles. The candle stand includes vertical rods that form a rigid tripod structure by attaching at the upper ends of the rods via washers, a pivoting, threaded attachment mechanism, and a threaded handle. The rods support horizontal rings that are provided with individual candle holders. The rods are provided with hooks spaced at intervals. The rings are provided with sets of projecting fingers that form channels. To attach the rings to the rods, the hooks are inserted into the corresponding channels on the rings. This forms an attractive, three-dimensional structure that is sufficiently rigid so as to hold a plurality of candles safely, yet is easily disassembled and collapsed into essentially flat components for easy shipping or storage.

24 Claims, 5 Drawing Sheets

COLLAPSIBLE CANDLE STAND

FIELD OF THE INVENTION

The present invention relates to a candle stand, and more particularly, to a candle stand having a plurality of individual candle holders. The invention further relates to a three-dimensional candle stand that is easily disassembled and collapsed for shipping or storage.

BACKGROUND OF THE INVENTION

Many candle holders, chandeliers, menorahs, candelabrums, and the like for holding and displaying candles are known. Such candle holders are designed to hold various different sizes and kinds of candles. Some, for example, hold a single taper or votive candle. Others are designed to hold multiple tapers, votives, tea lights, pillars, etc. Multiple candles may be displayed in a variety of configurations, such as rows, circles, pyramids, cones, or even shaped as letters of the alphabet.

Known candle holders all function in essentially the same manner, i.e., candles are placed in the holders and lighted. Thus, the only thing that may distinguish one candle holder from another is its appearance. The shape and style of the candle holder, therefore, operate as important determinants in the commercial success of the product.

Another feature, however, relating to certain candle holders, is their assembly. This is particularly applicable to candelabrums for multiple candles that may be formed by joining a number of individual candle holders via arms, branches, chains, or the like. Applicant has designed an innovative candle holder for multiple candles in an attractive, three-dimensional, inverse conical shape, that nonetheless is easily assembled and disassembled. As a result, the present invention is less expensive to ship, and is more easily packed and stored by the consumer.

The collapsible design of the present invention relates to that of various known light-supporting apparatuses. Such apparatuses typically are designed to have an inverted cone shape, but for an unrelated purpose, namely displaying strings of electric lights in order to simulate an indoor or outdoor Christmas tree. The Christmas tree designs typically comprise a central support with hoops or ropes to which the flexible light strings are attached.

Another known apparatus with a collapsible tripod structure is again designed for an unrelated purpose, namely holding suspended flare pots and/or flags for roadside use.

The present invention was developed with the above-noted objects in mind. Additional objects and advantages of the invention are set forth, in part, in the description which follows and, in part, will be apparent to one of ordinary skill in the art from the description and/or from the practice of the invention.

SUMMARY OF THE INVENTION

In response to the foregoing challenge, Applicant has developed an innovative collapsible candle stand comprising at least one vertically-oriented rod, having an upper end and a lower end; at least one horizontally-oriented ring, having a least one candle holder provided thereon; and means for removably attaching the at least one ring to the at least one rod.

The candle stand may further comprise a first rod, a second rod and a third rod that together form a tripod structure. The first rod may further comprise at least one hook provided thereon and a first washer rigidly attached at the upper end, the second rod may further comprise at least one hook provided thereon and a second washer rigidly attached at the upper end, and the third rod may further comprise at least one hook provided thereon, a third washer rigidly attached at the upper end, and an attachment mechanism attached to the third washer.

The candle stand of the present invention preferably further comprises a handle.

The tripod structure of the candle stand may be formed by attaching the first rod and the second rod to the third rod by inserting the attachment mechanism though the first washer and the second washer, and attaching the handle to the attachment mechanism.

The at least one ring may further comprise at least one channel provided thereon. The means for attaching the at least one ring to the at least one rod may further comprise removably inserting the at least one hook into the at least one channel. The channel may be formed by a set of spaced projecting fingers attached to the at least one ring.

The handle may further comprise a stem having threaded bore and the attachment mechanism may further comprise a pivot bolt having a head and a threaded end. The handle may be attached to the pivot bolt by screwing the threaded bore onto the threaded end of the pivot bolt, thereby rigidifying the tripod structure.

The present invention also contemplates a collapsible candle stand comprising a first vertically-oriented rod, having an upper end, a lower end, a first washer attached at the upper end, and at least one hook provided thereon; a second vertically-oriented rod, having an upper end, a lower end, a second washer attached at the upper end, and at least one hook provided thereon; a third vertically-oriented rod, having an upper end, a lower end, a third washer attached at the upper end, an attachment mechanism attached to the washer, and at least one hook provided thereon; and at least one horizontally-oriented ring, having a least one candle holder provided thereon and attached by an arm, the at least one ring removably attached to the first, second and third rods.

The attachment mechanism may further comprise a pivot bolt having a head and a threaded end. The candle stand of the present invention may further comprise a handle having a stem with a threaded bore.

A tripod structure may be formed by attaching the first rod and the second rod to the third rod by inserting the attachment mechanism though the first washer and the second washer, and attaching the handle to the attachment mechanism by screwing the threaded bore onto the threaded end of the pivot bolt.

The at least one horizontally-oriented ring may further comprise a first set of spaced projecting fingers, a second set of spaced projecting fingers, and a third set of spaced projecting fingers, attached to the ring. The first, second, and third sets of projecting fingers may form a first, second and third channel therebetween.

The at least one horizontally-oriented ring may be attached to the first, second and third rods by inserting the at least one hook from the first rod into the first channel, inserting the at least one hook from the second rod into the second channel, and inserting the at least one hook from the third rod into the third channel.

The present invention is also directed to a collapsible candle stand comprising horizontal means for holding a plurality of candles; vertical means for supporting the horizontal means; first attachment means for rigidly attaching the vertical means together to form a tripod; and second attachment means for rigidly attaching the horizontal means to the vertical means.

The first attachment means may further comprise at least one washer rigidly attached to the vertical means, a pivot bolt having a head and a threaded end, and a handle having a stem with a threaded bore, and the pivot bolt may attach the vertical means through the at least one washer while the handle is screwed onto the threaded end of the pivot bolt. The second attachment means may further comprise at least one hook attached to the vertical means and at least one channel formed on the horizontal means, wherein the at least one hook is removably inserted into the at least one channel.

In summary, therefore, the present invention comprises three rods that are vertically oriented in a triangular configuration. Several horizontal rings are attached to the rods at intervals; each ring has attached thereto several holders for individual candles. The rods are provided with several hooks and the rings are provided with corresponding projecting fingers. The candle stand is assembled by inserting the rods' hooks into channels formed by the rings' fingers. The candle stand is easily collapsed by separating the rings from the rods. By joining the rods and rings into this rigid tripod structure, the present invention is stable and thus safe for holding burning candles.

BRIEF DESCRIPTION OF THE DRAWINGS

It is to be understood that both the foregoing general description and the following detailed description are exemplary and explanatory only, and are not restrictive of the invention as claimed. The accompanying drawings, which are incorporated herein by reference, and which constitute a part of this specification, illustrate certain embodiments of the invention and, together with the detailed description, serve to explain the principles of the present invention.

DETAILED DESCRIPTION OF THE INVENTION

Figure 1:
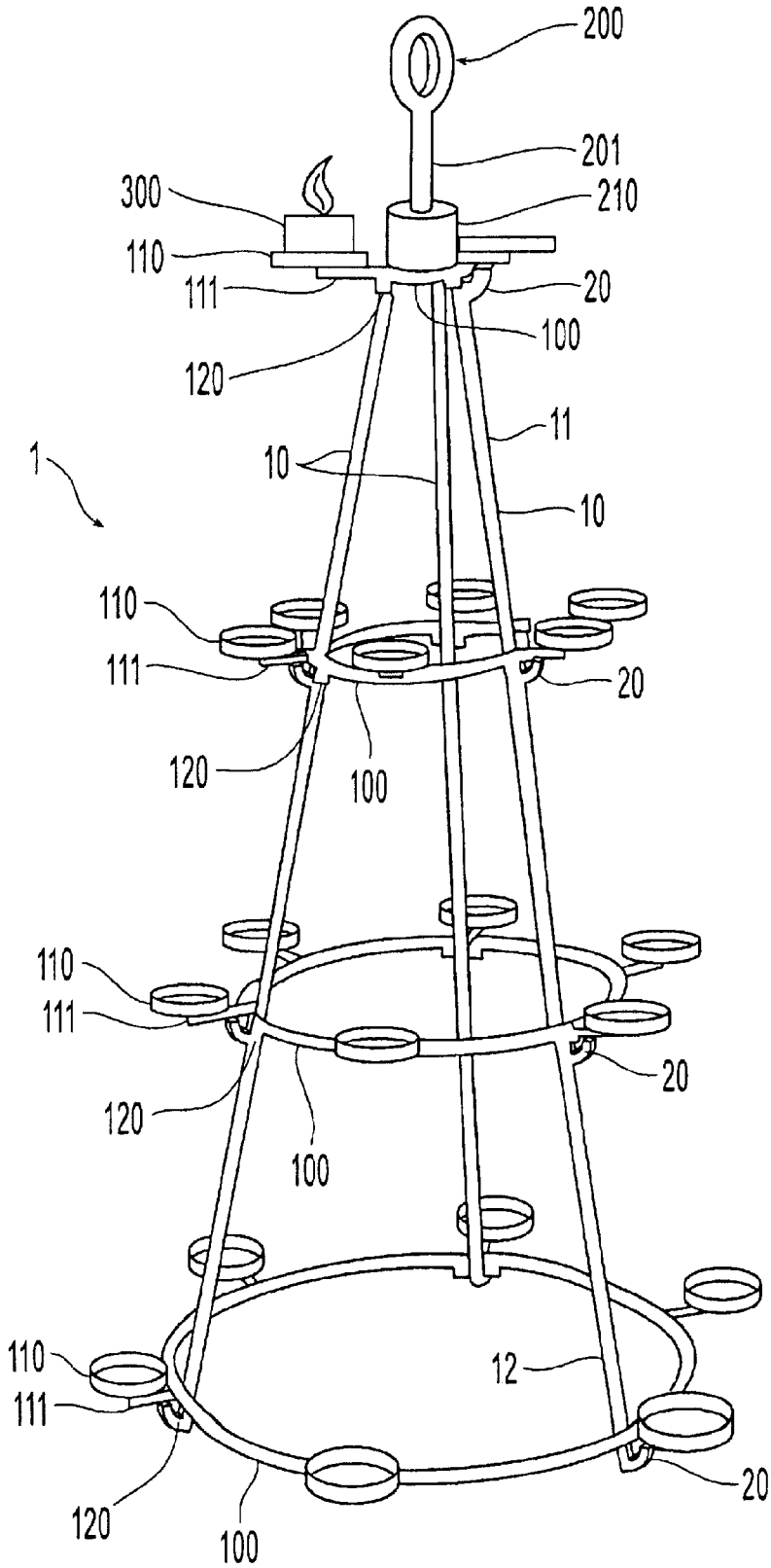
FIG. 1 is a schematic perspective view of a candle stand according to an embodiment of the present invention.

Referring now to FIG. 1, a preferred embodiment of the candle stand of the present invention is indicated generally by reference numeral 1. Candle stand 1 preferably comprises three rods 10 oriented in a vertical configuration to form a tripod. Each rod 10 further comprises an upper end 11 and a lower end 12. The three upper ends 11 are fitted together to form the closed end of the tripod, while the three lower ends 12 are spaced apart to form the base of the tripod. At the closed end of the tripod, a handle 200 preferably is attached to rods 10 via a stem 201. A cap 210 preferably is provided to cover the closed end of the tripod. At vertically spaced intervals along each rod 10, a plurality of hooks 20 is provided.

With continuing reference to FIG. 1, one or more horizontally-oriented rings 100 preferably are attached to rods 10 at vertically spaced intervals. Each of the rings 100 preferably further comprises a plurality of candle holders 110, preferably attached to ring 100 via arms 111. A candle 300 may be placed in each candle holder 110. Rings 100 preferably are each provided with a pair of substantially parallel projecting fingers 120 between which are formed channels 121. Rings 100 preferably are attached to rods 10 by inserting each hook 20 into a corresponding channel 121, as described in greater detail below.

The above-mentioned components of candle stand 1 preferably are made of any suitable metal (e.g., iron, steel, etc.) that provides adequate strength, durability, and ease of fabrication. The present invention contemplates, however, fabricating the components from any other material that provides the functionality described herein.

Figure 2:
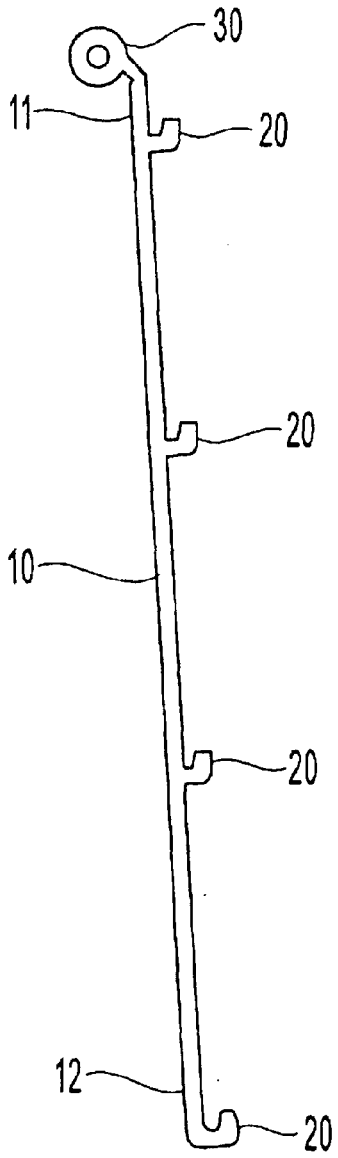
FIG. 2 is a side view of a vertical rod for a candle stand according to an embodiment of the present invention.

Referring now to FIG. 2, rod 10 is shown with washer 30 rigidly attached at upper end 11. As embodied herein, rod 10 preferably further comprises hooks 20, attached thereto and spaced at intervals as shown.

Figure 3:
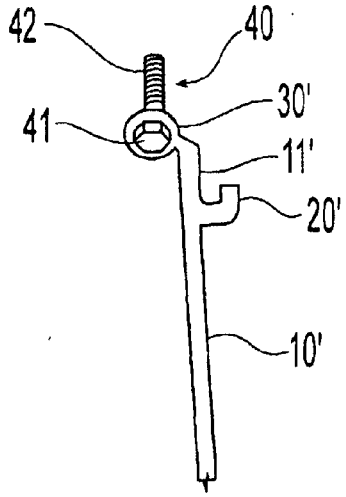
FIG. 3 is a side view of the upper portion of a rod with an attached threaded pivot bolt for a candle stand according to an embodiment of the present invention.

Referring now to FIG. 3, rod 10' is shown with washer 30' rigidly attached at upper end 11'. Rod 10' preferably further comprises attachment mechanism 40, which is fitted through washer 30'. Attachment mechanism 40 preferably is fixedly attached to washer 30' by any suitable means such as welding or gluing. As embodied herein, attachment mechanism 40 preferably is a pivot bolt, further comprising head 41 and threaded end 42. The present invention contemplates that attachment mechanism 40 may, however, be any suitable device that that provides the functionality described herein.

Figure 4:
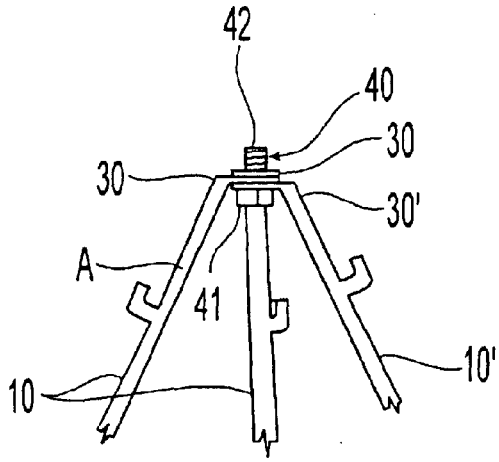
FIG. 4 is a side view of the upper portion of three rods and a threaded pivot bolt for a candle stand according to an embodiment of the present invention.

As shown in FIG. 4, two rods 10 and 10 preferably are stacked one upon the other by placing each respective washer 30 over the threaded end 42 of attachment mechanism 40, which itself is fixedly attached to washer 30' of rod 10'.

Figure 5:
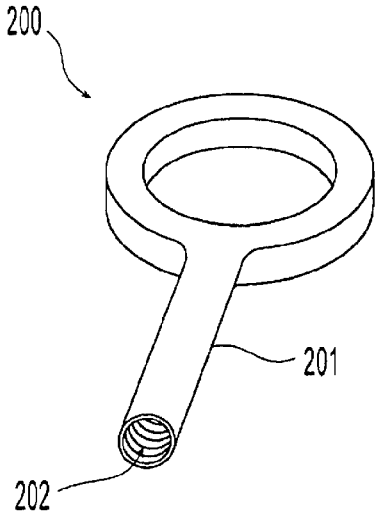
FIG. 5 is an enlarged, perspective view of a handle having a stem with a threaded bore for a candle stand according to an embodiment of the present invention.

Referring now to FIG. 5, handle 200 is shown with its stem 201 preferably having a threaded bore 202.

Figure 6:
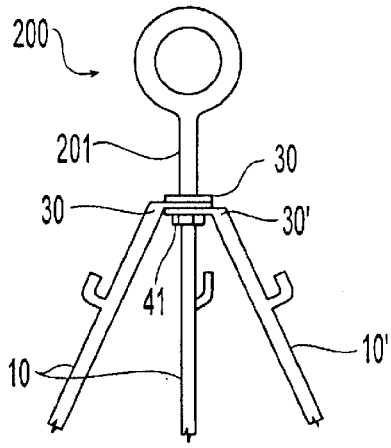
FIG. 6 is a side view of the upper portion of three rods, a threaded pivot bolt, and a threadably attached handle for a candle stand according to an embodiment of the present invention.

Referring now to FIG. 6, attachment mechanism 40 preferably attaches the three rods 10, 10 and 10' to each other in a rigid manner through washers 30, 30 and 30' by screwing threaded bore 202 in stem 201 of handle 200 onto threaded end 42 of attachment mechanism 40. Although rods 10, 10 and 10' become rigidly attached to each other, before handle 200 is fully tightened the design of the present invention allows for rotation of rods to the desired orientation, facilitating assembly. Prior to threading stem 201 of handle 200 onto attachment mechanism 40, a decorative cap 210 may be placed over upper ends 11 of rods 10 and 10', as shown in FIG. 1.

Figure 7:
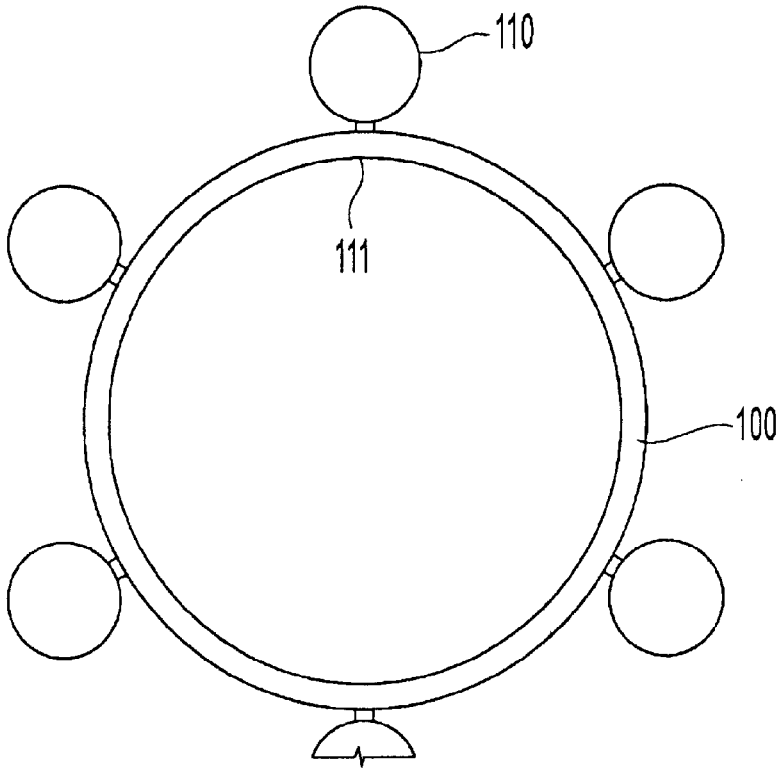
FIG. 7 is a top view of a ring and attached candle holders for a candle stand according to an embodiment of the present invention.

Referring now to FIG. 7, ring 100 is shown from above with a plurality of candle holders 110 rigidly attached thereto by means of respective arms 111.

Figure 8:
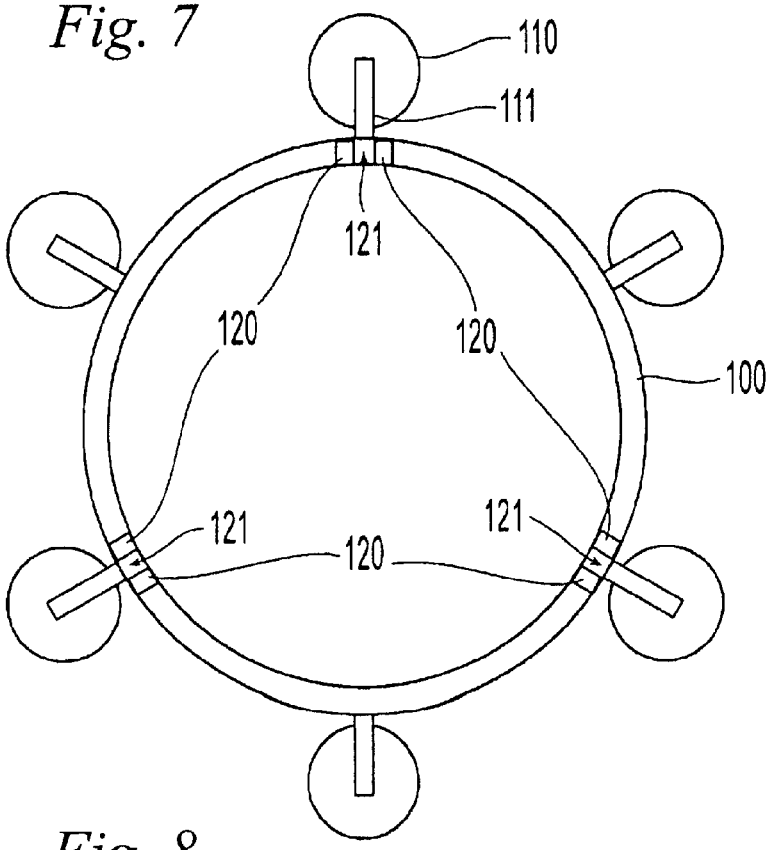
FIG. 8 is a bottom view of a ring, attached candle holders, and projecting fingers forming channels for a candle stand according to an embodiment of the present invention.
Figure 11:
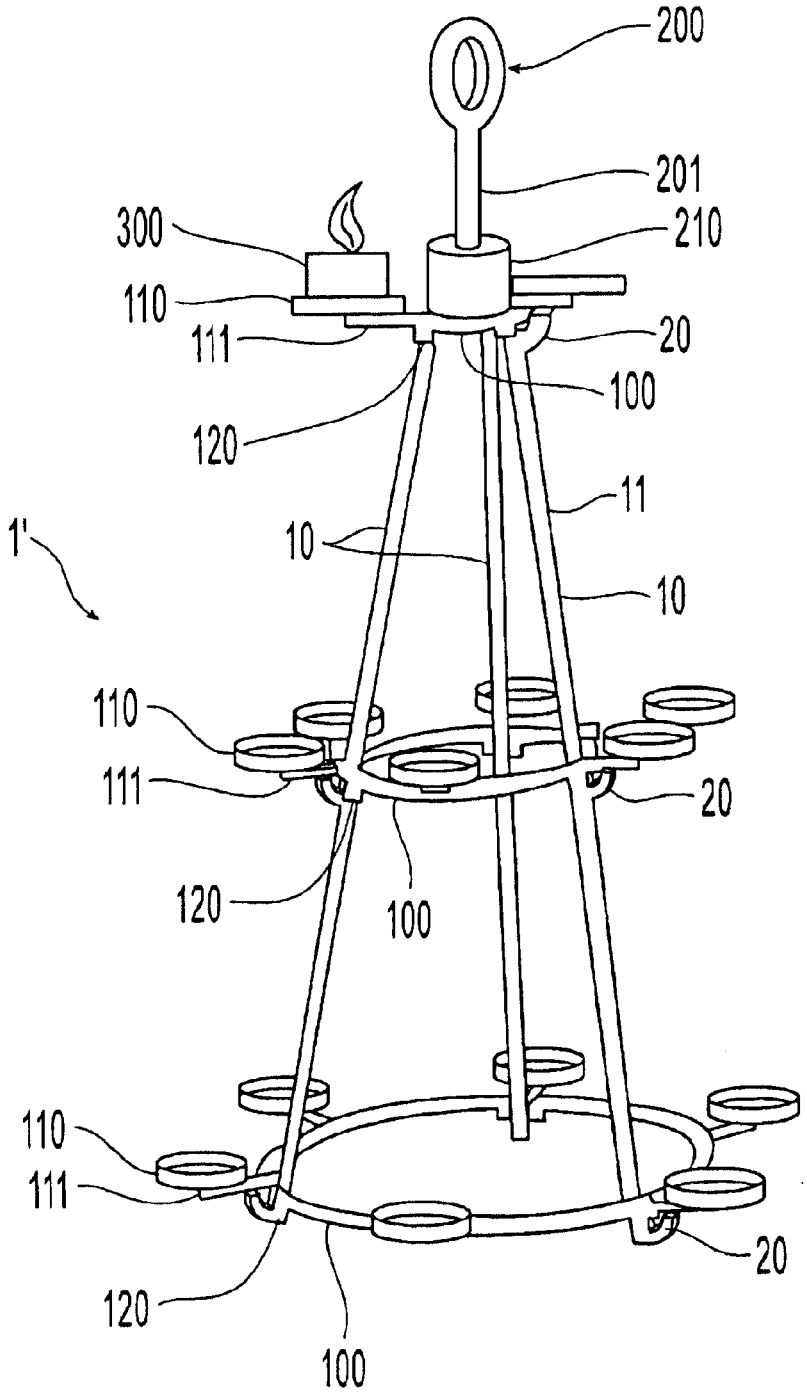
FIG. 11 is a schematic perspective view of a candle stand according to an alternate embodiment of the present invention.

Referring now to FIG. 8, ring 100 is shown from below with a plurality of candle holders 110 rigidly attached thereto by means of respective arms 111. Ring 100 preferably further includes three sets of projecting fingers 120 spaced about the circumference of ring 100 so as to form three channels 121. For each ring 100, the three sets of fingers 120 and corresponding channels 121 preferably line up with the three rods 10 and hooks 20, as described in greater detail below. As embodied herein, candle stand 1 preferably is provided with four rings 100, matching the four sets of hooks 20 on each rod 10. In alternate embodiments of the present invention, rods 10 may be provided with a greater or fewer number of hooks 20, and a corresponding number of rings 100, so as to make taller or shorter candle stands. For example, shown in FIG. 11 is a candle stand 1' having three rings 100.

Figure 9:
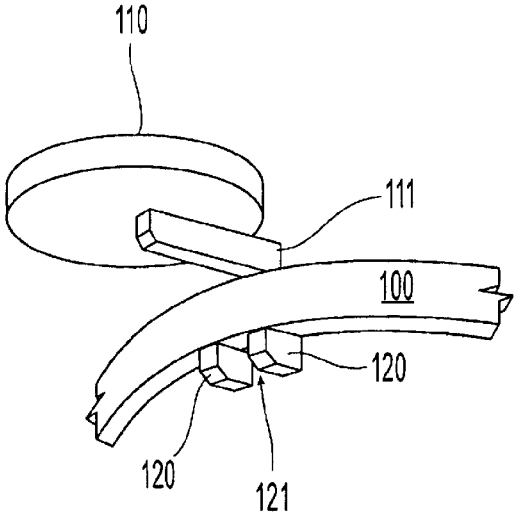
FIG. 9 is an enlarged, partial, perspective view of a ring with a single candle holder, attached arm, and projecting fingers forming a channel for a candle stand according to an embodiment of the present invention.

Referring now to FIG. 9, an enlarged portion of ring 100 is shown, with one candle holder 110 attached thereto by arm 111. As described above, ring 100 preferably is provided with three sets of projecting fingers 120, however, in this partial view, only one set of fingers 120 is shown. Fingers 120 preferably are rigidly attached to the underside of ring 100, preferably spaced so as to form channel 121.

Figure 10:
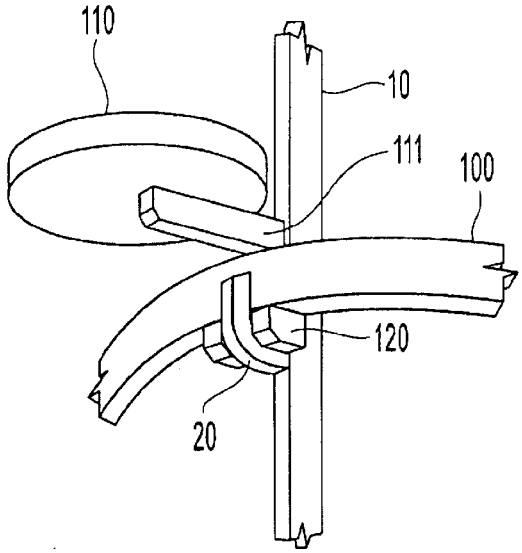
FIG. 10 is a an enlarged, partial, perspective view of a ring with a single candle holder, attached arm, and projecting fingers fitted onto a hook of a rod for a candle stand according to an embodiment of the present invention.

As shown in FIG. 10, channel 121 is sized to accommodate hook 20 such that hook 20 seats solidly in channel 121 between the two fingers 120, thus effectively locking ring 100 onto rod 10. To disassemble candle stand 1, ring 100 is removed from rod 10 by simply pulling up on ring 100 and down on rod 10 at the three points of attachment of hooks 20 and fingers 120. The design of the present invention thus provides an attractive, three-dimensional structure that is sufficiently rigid so as to hold a plurality of candles safely, yet is easily disassembled and collapsed into essentially flat components for easy shipping or storage.

It will be apparent to those skilled in that art that various modifications and variations can be made in the fabrication and configuration of the present invention without departing from the scope and spirit of the invention. For example, the number of rings may be varied to result in a candle stand that is shorter or taller than that shown. Further, the number and placement of the candle holders on the rings may be varied. A variety of materials may be used to fabricate the components of the invention.

As embodied herein, the present invention is directed to a design holding tea lights. The design and shape of the candle holders may be altered, however, to accommodate a variety of other candle types, such as tapers, pillars or votives. Further, it may be desirable to modify the hook and finger design that attaches the rings to the rods. For example, the channel may be provided in the ring itself, rather than formed by the projecting fingers.

In addition to circular, the handle may be any of a variety of shapes. The cap, being decorative, may also be formed into other shapes. Also, it may be advantageous to alter the design of the attachment mechanism. Thus, it is intended that the present invention cover the modifications and variations of the invention provided they come within the scope of the appended claims and their equivalents.

Further, the purpose of the following Abstract is to enable the U.S. Patent and Trademark Office, and the public generally, and especially the designers and practitioners in the art who are not familiar with patent or legal terms or phraseology, to determine quickly from a cursory inspection the nature and essence of the technical disclosure of the application. The Abstract is neither intended to define the invention of the application, which is measured solely by the claims, nor is intended to be limiting as to the scope of the invention in any way.

I claim as my invention:

1. A collapsible candle stand comprising:

first, second, and third vertically-oriented rods that together form a tripod structure, each of said first, second and third rods having an upper end and a lower end, wherein said first rod further comprises at least one hook provided thereon and a first washer rigidly attached at said upper end, and said second rod further comprises at least one hook provided thereon and a second washer rigidly attached at said upper end;

at least one horizontally-oriented ring, having a least one candle holder provided thereon; and means for removably attaching said at least one ring to said first, second and third rods.

2. The candle stand of claim 1, wherein said third rod further comprises at least one hook provided thereon, a third washer rigidly attached at said upper end, and an attachment mechanism attached to said third washer.

3. The candle stand of claim 2, further comprising a handle.

4. The candle stand of claim 3, wherein said tripod structure is formed by attaching said first rod and said second rod to said third rod by inserting said attachment mechanism though said first washer and said second washer, and attaching said handle to said attachment mechanism.

5. The candle stand of claim 4, wherein said at least one ring further comprises at least one channel provided thereon.

6. The candle stand of claim 5, wherein said means for attaching said at least one ring to said at least one rod further comprises removably inserting said at least one hook into said at least one channel.

7. The candle stand of claim 6, wherein said channel is formed by a set of spaced projecting fingers attached to said at least one ring.

8. The candle stand of claim 7, wherein said handle further comprises a stem having a threaded bore.

9. The candle stand of claim 8, wherein said attachment mechanism further comprises a pivot bolt having a head and a threaded end.

10. The candle stand of claim 9, wherein said handle is attached to said pivot bolt by screwing said threaded bore onto said threaded end of said pivot bolt, thereby rigidifying said tripod structure.

11. A collapsible candle stand comprising:

a first vertically-oriented rod, having an upper end, a lower end, a first washer attached at said upper end, and at least one hook provided thereon;

a second vertically-oriented rod, having an upper end, a lower end, a second washer attached at said upper end, and at least one hook provided thereon;

a third vertically-oriented rod, having an upper end, a lower end, a third washer attached at said upper end, an attachment mechanism attached to said washer, and at least one hook provided thereon; and at least one horizontally-oriented ring, having a least one candle holder provided thereon and attached by an arm, said at least one ring removably attached to said first, second and third rods.

12. The candle stand of claim 11, wherein said attachment mechanism further comprises a pivot bolt having a head and a threaded end.

13. The candle stand of claim 12, further comprising a handle having a stem with a threaded bore.

14. The candle stand of claim 13, wherein a tripod structure is formed by attaching said first rod and said second rod to said third rod by inserting said attachment mechanism though said first washer and said second washer, and attaching said handle to said attachment mechanism by screwing said threaded bore onto said threaded end of said pivot bolt.

15. The candle stand of claim 14, wherein said at least one horizontally-oriented ring further comprises a first set of spaced projecting fingers, a second set of spaced projecting fingers, and a third set of spaced projecting fingers, attached to said ring; and wherein said first, second, and third sets of projecting fingers respectively form first, second and third channels therebetween.

16. The candle stand of claim 15, wherein said at least one horizontally-oriented ring is attached to said first, second and third rods by inserting said at least one hook from said first rod into said first channel, inserting said at least one hook from said second rod into said second channel, and inserting said at least one hook from said third rod into said third channel.

17. A collapsible candle stand comprising:

at least three generally vertically-oriented rods, each having an upper end, a lower end, and being removably coupled together to form a substantially open generally conical space between said upper ends and said lower ends of said at least three rods; and first and second horizontally-oriented rings, each ring having at least one candle holder provided thereon, said first ring being removably supported by said at least three rods at a first height and said second ring being removably supported by said at least three rods at a second height different from said first height.

18. The candle stand of claim 17, further including a third horizontally-oriented ring, said third ring having at least one candle holder provided thereon, said third ring being removably supported by said rods at a third height different from said first and second heights.

19. The candle stand of claim 17, wherein said at least three rods further include a first set of hooks for supporting said first ring at said first height and a second set of hooks for supporting said second ring at said second height.

20. The candle stand of claim 19, further including a first washer rigidly attached at said upper end of said first rod, a second washer rigidly attached at said upper end of said second rod, a third washer rigidly attached at said upper end of said third rod, and an attachment mechanism attached to said third washer, wherein said tripod structure is formed by attaching said first rod and said second rod to said third rod by inserting said attachment mechanism though said first washer and said second washer.

21. A collapsible candle stand comprising:

at least three rods, each of which includes at least one hook provided thereon; and at least one ring supporting a plurality of candle holders circumferentially spaced apart from one another, wherein said at least three rods and said at least one ring are removably coupled together by said at least one hook supporting said at least one ring such that said at least three rods are generally vertically-oriented and said at least one ring is horizontally-oriented.

22. The candle stand of claim 21, wherein said at least one ring comprises first and second rings, each of said rings supporting a plurality of candle holders circumferentially spaced apart from one another, wherein said at least three rods and said first and second rings are removably coupled together by supporting said first and second rings by said at least one hook such that said first and second rings are horizontally-oriented and said first ring is supported at a first height and said second ring is supported at a second height different from said first height.

23. The candle stand of claim 22, wherein said at least three rods and said first and second rings are formed of metal.

24. The candle stand of claim 21, wherein said at least one hook of each of said at least three rods further includes a first hook and a second hook, said at least one ring further includes first and second rings, and said first hooks support said first ring at a first height and said second hooks support said second ring at a second height different from said first height.

* * * * *